US007275310B2

(12) United States Patent
Suzuki

(10) Patent No.: US 7,275,310 B2
(45) Date of Patent: Oct. 2, 2007

(54) METHOD FOR MANUFACTURING INK-JET RECORDING HEAD

(75) Inventor: Takumi Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 11/014,596

(22) Filed: Dec. 16, 2004

(65) Prior Publication Data

US 2005/0140735 A1 Jun. 30, 2005

(30) Foreign Application Priority Data

Dec. 26, 2003 (JP) ..... 2003-434527
Nov. 11, 2004 (JP) ..... 2004-327664

(51) Int. Cl.
*H05B 3/16* (2006.01)
*B21D 53/76* (2006.01)

(52) U.S. Cl. ..... 29/611; 29/890.1; 347/47; 347/56; 347/61

(58) Field of Classification Search ..... 29/611, 29/890.1, 830; 347/29, 47, 56, 61–63, 65
See application file for complete search history.

(56) References Cited

U.S. PATENT DOCUMENTS 5,141,596 A 8/1992 Hawkins
5,458,254 A * 10/1995 Miyagawa et al. ..... 347/63 X

FOREIGN PATENT DOCUMENTS

| | | | |
|---|---|---|---|
| JP | 04-52050 | 5/1992 | |
| JP | 05-254120 | 5/1993 | |
| JP | 5-318742 | * 12/1993 | ..... 29/890.1 X |
| JP | 2000-094700 | 4/2000 | |
| JP | 2003-311966 | 11/2003 | |

* cited by examiner

*Primary Examiner*—A. Dexter Tugbang
(74) *Attorney, Agent, or Firm*—Canon U.S.A. Inc I. R. Div

(57) ABSTRACT

A method for manufacturing an ink-jet recording head. The method includes forming a photosensitive resin layer on a support component and forming through holes in the resin layer. Since the diameters of the through hole on both sides of the photosensitive resin layer are made equal, the bonding area of a filter to a substrate is ensured, and the aperture area of the through hole per unit area is increased. A maximum aperture diameter is made to be smaller than or equal to a maximum linear distance between intersection points of a straight line passing through the geometric center of the ejection nozzle and an edge of the ejection nozzle. The head substrate and the filter are press-contacted. The support component is removed. The resulting recording head can prevent a reduction of the yield due to non-ejection of ink.

8 Claims, 7 Drawing Sheets

FIG. 1 PRIOR ART
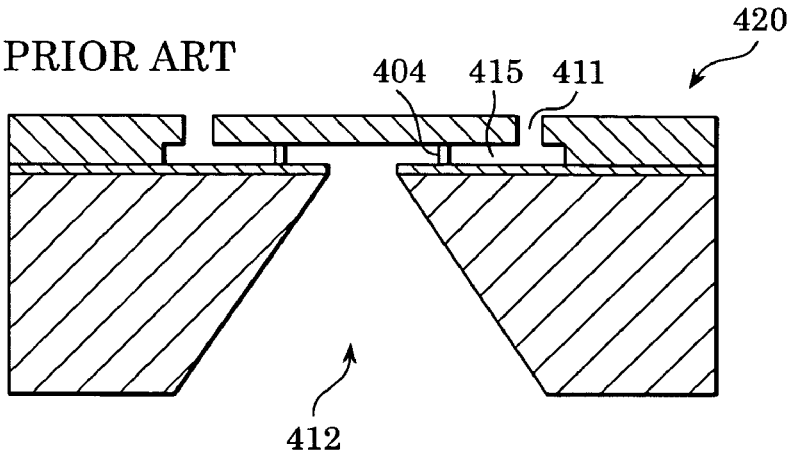
FIG. 2A
PRIOR ART
FIG. 2B
PRIOR ART
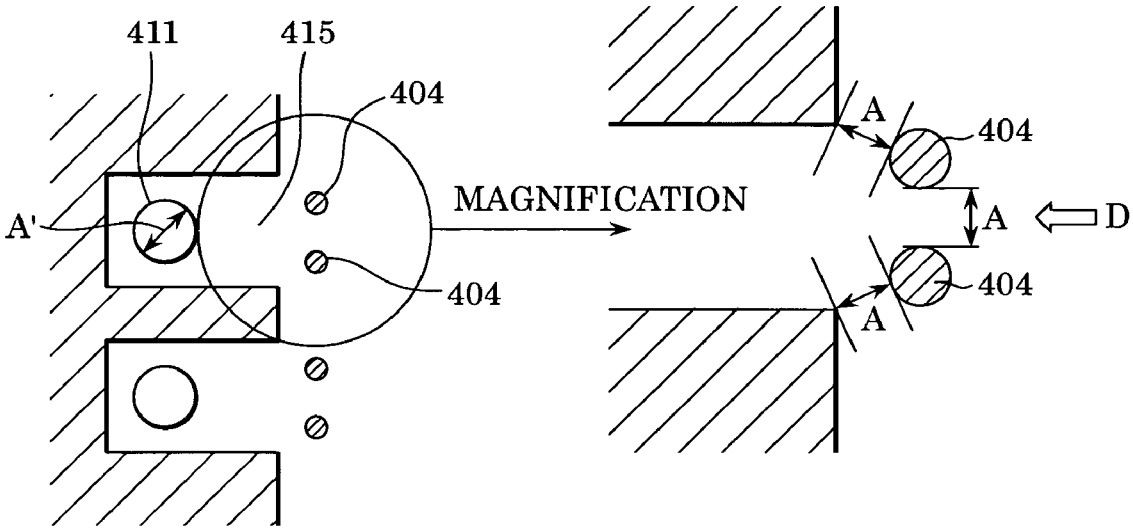
FIG. 2C
PRIOR ART
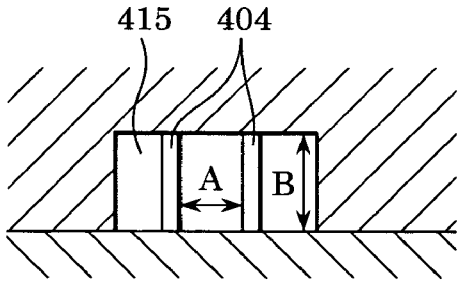

METHOD FOR MANUFACTURING INK-JET RECORDING HEAD

BACKGROUND OF THE INVENTION

1. Field of the Invention

The present invention relates to an ink-jet recording head provided with a filter and a method for manufacturing the same. In particular, the present invention relates to an ink-jet recording head provided with an ink supply hole penetrating from a bottom surface to a top surface of a substrate including a plurality of ejection nozzles and a method for manufacturing the ink-jet recording head.

2. Description of the Related Art

Known ink-jet recording heads can form fine ink droplets by downsizing ejection nozzles to eject ink, and have become mainstream photorealistic printers in recent years. However, as ejection nozzles become finer, a problem of clogging of the ejection nozzle occurs due to dust contained in ink.

Consequently, ink-jet recording heads incorporating filters to remove the dust have been developed.

FIG. 1 is a sectional side view showing an example of a known ink-jet recording head provided with a filter.

An ink-jet recording head 420 includes electrothermal conversion elements, although not shown in the drawing, which generate thermal energy to initiate film boiling of ink in accordance with electric signals, in an ink flow path 415; ejection nozzles 411 to eject ink, located at positions in accordance with electrothermal conversion elements; an ink supply hole 412 to supply ink from an ink tank to the ink flow path 415; and a columnar filter 404 disposed in the ink flow path 415. As shown in FIGS. 2A-C, this filter 404 is disposed in such as manner that a spacing A in the filter 404 is smaller than or equal to a maximum linear distance between intersection points of a straight line passing through the geometric center of the ejection nozzle 411 and an edge of the ejection nozzle 411 in a plan view when viewed from an ejection nozzle surface (top surface) side. That is, in the configuration shown in FIGS. 2A-C, since the ejection nozzle is circular, the geometric center of the ejection nozzle 411 is the center of the circle. Therefore, a straight line passing through this center and having a maximum distance between points of intersection with the circumference of the circle of the ejection nozzle 411 refers to a diameter (refers to a major axis when the ejection nozzle 411 is elliptical, for example). Accordingly, the filter 404 is disposed such that the spacing A is smaller than or equal to the diameter A' of the ejection nozzle 411.

With respect to the filter 404 in which columns are set up in the ink flow path 415, when the two-dimensional relationship between positions is viewed from the top surface, the spacing A shown in FIGS. 2A-C is smaller than or equal to the diameter of the ejection nozzle 411. However, in the recording head which ejects fine droplets, even when the diameter of an ejection nozzle is reduced, it is difficult to correspondingly decrease the ink flow path height B because the performance of refilling ink must be maintained. Consequently, when such a recording head is viewed from the direction indicated by an arrow D shown in FIG. 2B, since the height B of the ink flow path 415 is larger than the spacing A in the filter 404, as shown in FIG. 2C, if slim dust flows into the ink flow path 415 while being vertically oriented, the dust passes through the filter 404. However, the dust cannot be ejected through the ejection nozzle 411, so that non-ejection of the ink may result.

On the other hand, schemes to prevent the entrance of dust may be devised. A component provided with fine holes may be attached to an ink supply hole for supplying ink to a plurality of ink flow paths, or a part of an ink flow path may be processed to have through holes.

For example, Japanese Patent Laid-Open No. 5-254120 discloses a method, in which fine through holes are formed by downstream processing in appropriate portions of an ink flow path and a liquid chamber. In this method, a component having an adequate strength to form the ink flow path and the liquid chamber is required. In general, laser processing is used for boring through holes therein. However, when the downstream processing is performed by laser processing or other means, dust may enter into the ink flow path and the liquid chamber during the formation of through holes in the component. As a result, since the dust cannot be taken out because of the characteristic of the through holes (filter), a cause of non-ejection of ink may be generated defying expectations.

Japanese Patent Laid-Open No. 5-208503 (corresponding U.S. Pat. No. 5,141,596) discloses a method, in which silicon is subjected to ion implantation and, thereby, a portion sensitive to etching and a portion resistant to etching are formed, so that an ink supply hole and an ink chamber are formed and, at the same time, through holes are bored, the through holes having a dimension smaller than or equal to a minimum distance between two intersection points of a straight line passing through the geometric center of the ejection nozzle and a circumference of the above-described ejection nozzle.

However, in this method, since the area of the through holes are determined based on the diffusion of ions, the concentration due to diffusion does not become two values corresponding to a portion sensitive to etching and a portion resistant to etching, but there are gradations in concentration. Therefore, the size of the through holes cannot be precisely controlled. Since anisotropic etching is performed from a surface opposite to the surface to be provided with through holes, if the area of the portion provided with through holes (filter) is increased, the area to become a liquid chamber is increased and, therefore, the formation becomes difficult. Therefore, the area of the portion to be provided with the through holes is restricted. The portion to be provided with the through holes becomes very narrow since the formation is performed by anisotropic etching of silicon. Consequently, when solid printing or the like in which ink is ejected from a plurality of ejection nozzles is performed, a pressure drop is increased and, therefore, high-speed printing becomes difficult. Furthermore, since the liquid chamber is disposed, alignment is required for joining to a wafer including ejection nozzles.

Japanese Patent Laid-Open No. 2000-094700 discloses that the above-described fine through holes are formed in a portion having a large area. However, since the formation of an ink supply hole is performed simultaneously, an etching solution for forming the ink supply hole must be penetrated through the fine through holes, and when a mold material for the ink flow path is removed, the mold material for the ink flow path must be fused and removed under the condition in which both the ejection nozzle and the through holes are small holes. Therefore, the operability of the removal is poor, and this method is impractical.

SUMMARY OF THE INVENTION

The present invention is directed to an ink-jet recording head not only capable of preventing a reduction of the yield due to non-ejection of ink and reducing a cost, but also compatible with high-speed printing, and therefore, adaptable to a high-quality printer which ejects small droplets. The present invention is also directed to a method for manufacturing an ink-jet recording head.

In one aspect of the present invention, an ink-jet recording head includes: a substrate having a first surface and a second surface opposing the first surface; ejection nozzles provided about the first surface; thermal energy generating elements disposed about the ejection nozzles at the first surface; an ink supply hole penetrating through the above-described first surface to the above-described second surface; and a filter disposed on the second surface of the above-described substrate such that the filter covers the ink supply hole at the second surface, wherein the filter includes a plurality of through holes, wherein each through hole has an aperture diameter smaller than or equal to a maximum linear distance between intersection points of a straight line passing through the geometric center of the above-described ejection nozzle and an edge of the above-described ejection nozzle.

In the ink-jet recording head having the above-described configuration, according to the present invention, a filter is provided with through holes formed in order that dust which cannot be ejected through the ejection nozzle due to a large size (that is, a size which can causes clogging of the ejection nozzle) does not pass through the filter. Therefore, non-ejection of the ejection nozzle can be prevented from occurring due to dust passed through the filter.

In another aspect, a method for manufacturing an ink-jet recording head includes the steps of: forming a support component; forming a resin layer on the support component; forming a plurality of through holes in the above-described resin layer such that each through hole has an aperture diameter smaller than or equal to a maximum linear distance between intersection points of a straight line passing through the geometric center of the above-described ejection nozzle and an edge of the above-described ejection nozzle; forming a substrate including a first surface and a second surface opposing the first surface, the ejection nozzles provided about the first surface, thermal energy generating elements disposed about the ejection nozzles at the first surface, and an ink supply hole penetrating through the first surface to the second surface; joining the resin layer to the second surface of the substrate; and removing the support component from the above-described resin layer.

In the above-described method for manufacturing an ink-jet recording head, according to the present invention, a filter is provided with through holes formed in order that dust which cannot be ejected through the ejection nozzle due to a large size does not pass through the filter. This filter is joined to a bottom surface side of the substrate where the ink supply hole has a large aperture area. Consequently, an ink-jet recording head produced by the manufacturing method of the present invention can prevent non-ejection of the ejection nozzle from occurring due to dust passing through the filter. In addition, the number of through holes becomes larger than that in the case where a filter is disposed on the top surface side of the substrate and, therefore, the resistance to flow can be reduced when the ink flows into the ink flow path. That is, the manufacturing method of the present invention can produce an ink-jet recording head not only capable of preventing a reduction of the yield due to non-ejection of ink and reducing a cost, but also compatible with high-speed printing, and therefore, adaptable to a high-quality printer which ejects small droplets.

As described above, according to the ink-jet recording head of the present invention, the reduction of the yield due to non-ejection of ink can be prevented, the cost can be reduced. In addition, the recording head is compatible with high-speed printing and, therefore, is adaptable to a high-quality printer which ejects small droplets.

Further features and advantages of the present invention will become apparent from the following description of the embodiments (with reference to the attached drawings).

BRIEF DESCRIPTION OF THE DRAWINGS

FIG. 1 is a sectional side view showing an example of the structure of a known ink-jet recording head provided with a filter.

FIGS. 2A to 2C are partial sectional views showing a detailed structure of the filter of the ink-jet recording head shown in FIGS. 5A to 5E.

FIG. 7A is a perspective view for explaining the condition in which a support component and a filter are joined to a substrate. FIG. 7B is a schematic diagram for explaining positions of the filter and an ink supply hole when the ink-jet recording head in which the filter is joined by the method shown in FIG. 7A is viewed from the back.

FIG. 8A is a sectional side view. FIG. 8B is a schematic diagram for explaining positions of a filter and ink supply holes when the recording head is viewed from the back.

DESCRIPTION OF THE EMBODIMENTS

First Embodiment

FIGS. 3A to 3D are step diagrams showing a filter formation process in the method for manufacturing an ink-jet recording head according to the present embodiment.

Figure 3A:
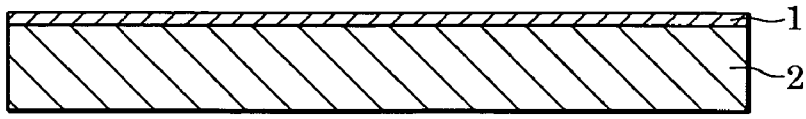
FIGS. 3A to 3D are step diagrams showing a filter formation process in the method for manufacturing an ink-jet recording head according to a first embodiment of the present invention.
Figure 3B:
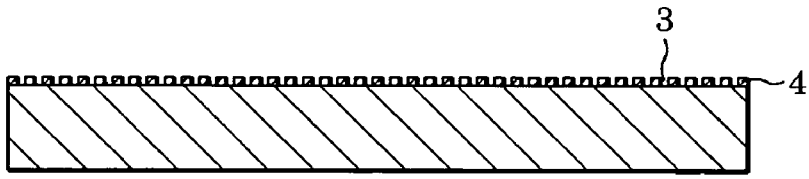
Figure 3C:
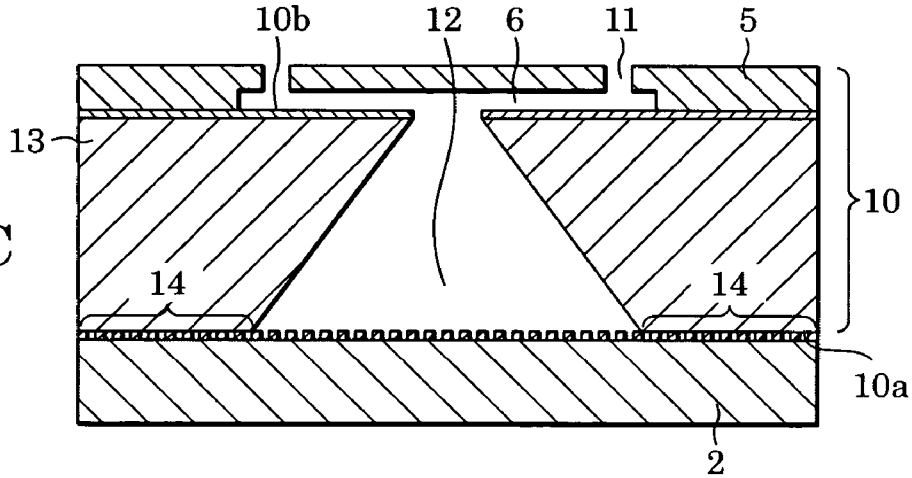

Silicon, aluminum that is a metal capable of being etched, or the like serving as a support component 2 to support a photosensitive resin layer 1 described below is formed to have a size similar to the size of a silicon wafer to form a head substrate 10 (FIG. 3C). This support component 2 is spin-coated with an epoxy resin of about 20 μm in thickness containing a photopolymerization initiator. Pre-baking is performed in order to evaporate a solvent in the resin, so that the photosensitive resin layer 1 is formed (FIG. 3A).

The method for manufacturing the photosensitive resin layer 1 is not limited to the above-described spin coating method, and may be a spraying method, a printing method, or the like. A desired thickness of coating can be applied by various methods, for example: a slit coating method can be performed in which discharge is performed linearly from a slit having a constant width and, thereby, a wafer is coated at a uniform speed and a uniform interval; a method in which spinning is performed after the slit coating; and a method in which a rotating wafer is coated from a center or a perimeter portion while a dropping nozzle is moved in a manner similar to that in the case where a picture is drawn with a single stroke of the brush.

This photosensitive resin layer 1 is of a negative type, and a portion exposed to light is cross-linked to become insoluble in a developing solution, so that patterning can be performed. A vertical hole having a diameter of about 5 μm can be formed with respect to a thickness of 20 μm. In the present embodiment, the thickness of the photosensitive resin layer 1 is set at about 20 μm for safety. However, the thickness can be further decreased when a pressure drop of ink is large. In addition to liquid resins, a photosensitive epoxy resin (SU-8 2005 produced by MicroChem Corp., or the like) may be made into a dry film and laminated on the support component 2.

The photosensitive resin layer 1 is exposed to light with an exposure apparatus by the use of a mask of through holes 3 (not shown in the drawing). In the present embodiment, circular through holes having a diameter of about 6 μm are formed. The resin used in the present embodiment is of a negative type, and a portion not exposed to light is dissolved in a developing solution, and a portion exposed to light is cross-linked to become insoluble in the developing solution. A mixed solution of methyl isobutyl ketone (MIBK) and xylene is used as the developing solution. Alternatively, no photosensitive resin is used in contrast to the present embodiment, a thermosetting epoxy resin may be disposed and, thereafter, the resin may be coated with a resist having high resistance to etching. Subsequently, a pattern of the through holes 3 may be formed with an exposure apparatus in a manner similar to that in the above-described method, and the through holes 3 may be formed by dry etching.

With respect to the area of a region to be provided with through holes 3, the through holes 3 are disposed all over the photosensitive resin layer 1, or the through holes 3 are disposed in an area larger than the aperture area in a bottom surface 10*a* side of an ink supply hole 12. In this manner, even when the region provided with the through holes 3 and the ink supply hole 12 are somewhat misaligned in the arrangement, since the portion provided with the through holes 3 of a filter 4 is located at the portion of the ink supply hole 12 with no problem, intentional alignment becomes unnecessary.

Figure 4A:
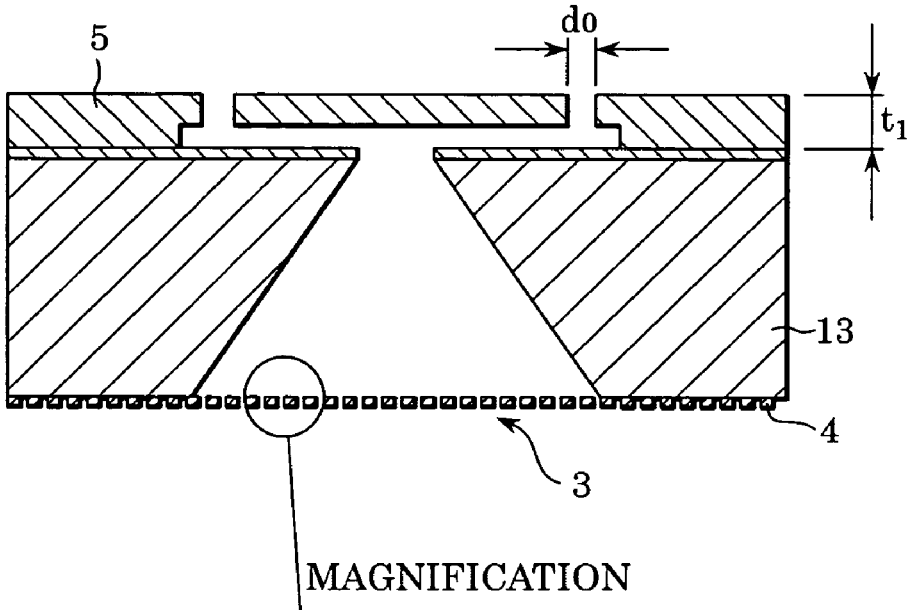
FIGS. 4A to 4C are schematic diagrams for explaining the difference in aperture diameters of through holes depending on the methods for forming a filter.
Figure 4B:
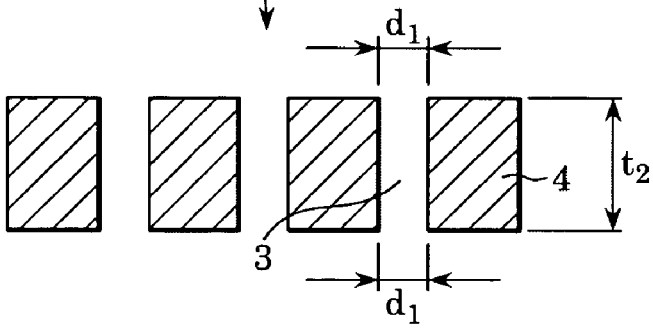

Here, FIGS. 4A to 4C will be described. When the through holes 3 are formed by exposing the photosensitive resin layer 1 to light with an exposure apparatus by the use of a mask of the through holes 3, the diameters of the through hole on both surface sides of the photosensitive resin layer 1 are allowed to become the same diameter d1 (FIGS. 4A and 4B).

Figure 4C:
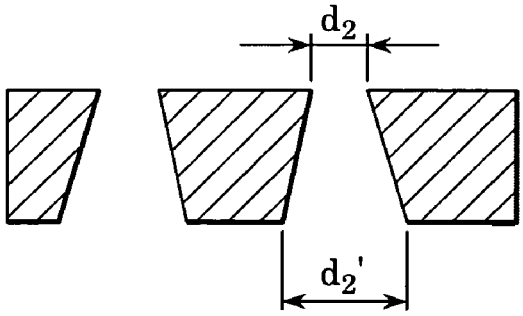

On the other hand, when through holes 3' having a diameter of d2 are formed by anisotropic etching of silicon, as shown in FIG. 4C, the diameter d2' in the anisotropic etching start side becomes larger than the diameter d2. Consequently, the aperture area per unit area of the through holes 3' inevitably becomes smaller than that in the present embodiment. When the through holes 3' are formed by anisotropic etching and, in addition, the aperture area per unit area of the through holes 3' is increased, a bonding area to the substrate cannot be adequately ensured. As described above, according to the manufacturing method of the present embodiment, a bonding area of the filter 4 to the substrate 13 can be ensured adequately and, in addition, the aperture area per unit area of the through holes 3 can be increased.

The diameter d1 of the through hole 3 is made smaller than or equal to a maximum linear distance between intersection points of a straight line passing through the geometric center of the ejection nozzle 11 and an edge of the ejection nozzle 11 in the plan view when viewed from the ejection nozzle surface (top surface) side. That is, when the ejection nozzle 11 is circular, the diameter d1 is made smaller than or equal to the diameter d0 of the ejection nozzle 11 (FIGS. 4A and 4B). When the shape of the ejection nozzle 11 is, for example, elliptical, a maximum distance between intersection points of a straight line passing through the geometric center of the ejection nozzle 11 and an edge of the ejection nozzle 11 refers to a major axis and, in this case, the diameter d1 of the through hole 3 is shorter than the major axis of the elliptical ejection nozzle 11. When the shape of the ejection nozzle 11 is rectangular, a maximum distance between intersection points of a straight line passing through the geometric center of the ejection nozzle 11 and an edge of the ejection nozzle 11 refers to a diagonal and, in this case, the diameter d1 of the through hole 3 is shorter than the diagonal of the rectangular ejection nozzle 11.

After the through holes 3 are formed as described above, in order to improve the chemical agent resistance, baking is performed at 100° C. for 1 hour, so that a filter 4 is formed on the support component 2 (FIG. 3B).

Subsequently, about 5 μm of polyamide is transferred to the bottom surface 10*a* of the head substrate 10.

The head substrate 10 is formed beforehand by the usual procedure. However, the procedure is suspended before high-temperature baking to enhance the adhesion of a flow-path-forming component to a substrate 13, while the flow-path-forming component forms a plurality of ejection nozzles 11 and channels serving as a plurality of ink flow paths 6 in accordance with respective ejection nozzles 11. That is, the head substrate 10 is formed beforehand as described below. Thermal energy generating elements, although not shown in the drawing, to generate thermal energy for ejecting ink are disposed at positions in accordance with the plurality of ejection nozzles 11, on a top surface 10*b* of the substrate 13. Mold materials (not shown in the drawing) in accordance with the channels serving as the plurality of ink flow paths 6 are formed on the substrate 13. Furthermore, a nozzle material serving as a flow-path-forming component 5 is formed to cover the mold materials. The ink supply hole 12 is formed by anisotropic etching from the bottom surface 10*a* side. In this manner, the ink supply hole 12 having an aperture area in the bottom surface 10*a* side larger than that in the top surface 10*b* side is formed. Subsequently, the mold materials in accordance with the channels serving as the ink flow paths 6 are removed and, thereby, the ejection nozzles 11 and the ink flow paths 6 are formed by the flow-path-forming component 5, so that the head substrate 10 is formed. However, the procedure is suspended before the final high-temperature baking to enhance the adhesion of the flow-path-forming component 5.

The polyamide is transferred to the bottom surface 10*a* of the head substrate 10 prepared beforehand as described above. In the transferring method, Teflon is coated with the polyamide of 5 μm in thickness, and the head substrate 10 is placed thereon. Consequently, the polyamide does not enter the ink supply hole 12, and the polyamide can be transferred only on a bonding portion 14. When etching is performed vertically, the aperture areas of the ink supply hole 12 in the ejection nozzle 11 side and the bottom surface 10*a* side become equal to each other. When the ink supply hole 12 is formed by anisotropic etching of the substrate 13 made of silicon, the aperture area in the bottom surface 10*a* side becomes the largest. Therefore, it is desirable that the ink supply hole 12 is formed by anisotropic etching of the silicon substrate 13. The polyamide used as an adhesive in the present embodiment can be, for example, HL-1200 produced by Hitachi Chemical Company, Ltd.

A bonding surface, which is the photosensitive resin layer 1 side of the support component 2 supporting the photosensitive resin layer 1 provided with the through holes 3, is placed on the bonding portion 14 of the bottom surface 10*a* of this head substrate 10, and these are press-contacted in order that no gap is created therebetween. Under this condition, heating is performed in an oven at 200° C. for 1 hour, so that the polyamide is cured, and the photosensitive resin layer 1 provided with the through holes 3 and the head substrate 10 are brought into intimate contact (FIG. 3C).

The support component 2 is removed. In the present embodiment, a jig (not shown in the drawing) is used to avoid contact of an etching solution with the surface provided with ejection nozzles 11 of the head substrate 10, and the support component 2 is removed by being dissolved in an organic alkali, tetramethylammonium hydroxide (TMAH), heated to 85° C. In the present embodiment, the support component 2 has a thickness of about 0.2 mm, and is completely removed after about 6 hours. In addition to this, examples of methods for removing the support component 2 may include a technique for slimming a substrate, e.g., back grind, chemical mechanical planarization (CMP), or spin etching.

Figure 3D:
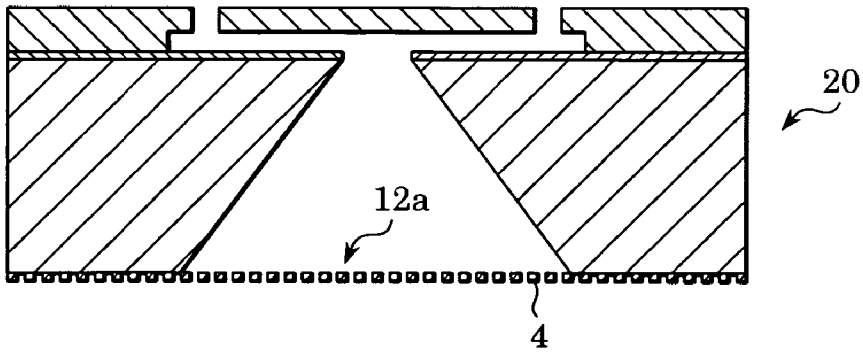

Washing with water is performed after the support component 2 is removed, so that an ink-jet recording head 20 provided with the filter 4 on the aperture 12*a* of the ink supply hole 12 is formed (FIG. 3D).

Thereafter, as in the known manner, the wafer is separated to have a required shape, an external electrode is connected and, for example, a component to connect to an ink tank is attached.

In this manner, the ink-jet recording head 20 according to the present embodiment, provided with the filter 4 is completed, wherein the filter 4 is formed in order that the diameter of the through hole 3 is made smaller than or equal to a maximum linear distance between intersection points of a straight line passing through the geometric center of the ejection nozzle 11 and an edge of the ejection nozzle 11.

In the filter 4 of the ink-jet recording head 20 in the present embodiment, the through hole 3 has the above-described aperture dimension. Consequently, dust passing through the through holes 3 of the filter 4 has a size which allows the dust to be ejected from the ejection nozzle 11 and, therefore, the problem of non-ejection of ink due to dust passing through the filter is overcome.

Since the filter 4 is joined to the bottom surface 10*a* side of the substrate 13, where the ink supply hole 12 has a large aperture area, the number of through holes becomes larger than that in the case where the filter is disposed in the top surface side of the substrate. Therefore, the resistance to flow can be reduced when the ink flows into the ink flow path. That is, the ink-jet recording head 20 in the present embodiment is not only capable of preventing a reduction in yield due to non-ejection of ink and reducing a cost, but also is compatible with high-speed printing and, therefore, an ink-jet recording head adaptable to a high-quality printer which ejects small droplets can be produced.

The filter 4 of the ink-jet recording head 20 in the present embodiment has a thickness $t_2$ of about 20 μm, while the flow-path-forming component 5 has a thickness $t_1$ of about 20 to 30 μm. Since the thickness of the filter is made to be the same level (the same order) as the thickness of the flow-path-forming component, and resin layers having the same level of thickness are disposed on both surfaces of the substrate, warp of the substrate generated when the flow-path-forming component is brought into intimate contact with the substrate in FIG. 3C can be reduced. In order to realize the above-described reduction of warp, it is desirable to dispose the filter 4 all over the bottom surface of the substrate.

Second Embodiment

FIGS. 5A to 5E are step diagrams showing a filter formation process in a method for manufacturing an ink-jet recording head according to a second embodiment.

In the present embodiment, an etching-protective film is formed in the step of forming the filter, and other steps are similar to those in the first embodiment. Therefore, only the steps different from those in the first embodiment will be described below in detail.

Figure 5A:
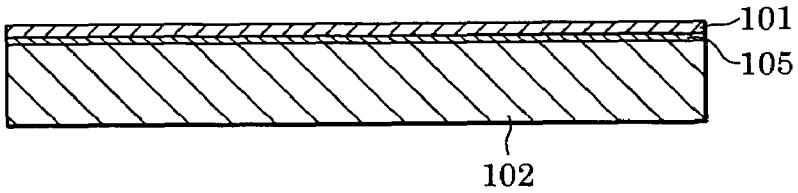
FIGS. 5A to 5E are step diagrams showing a filter formation process in the method for manufacturing an ink-jet recording head according to a second embodiment of the present invention.
Figure 5B:
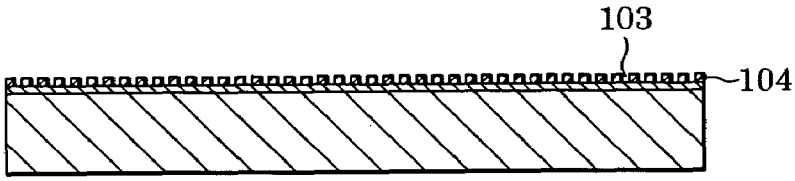

About 3,000 angstroms of silicon dioxide ($SiO_2$) serving as an etching-protective film 105 is formed on a support component 102, on the side to be provided with a photosensitive resin layer 101. Subsequently, the photosensitive resin layer 101 is formed on the etching-protective film 105 in a manner similar to that in the first embodiment (FIG. 5A).

Figure 5C:
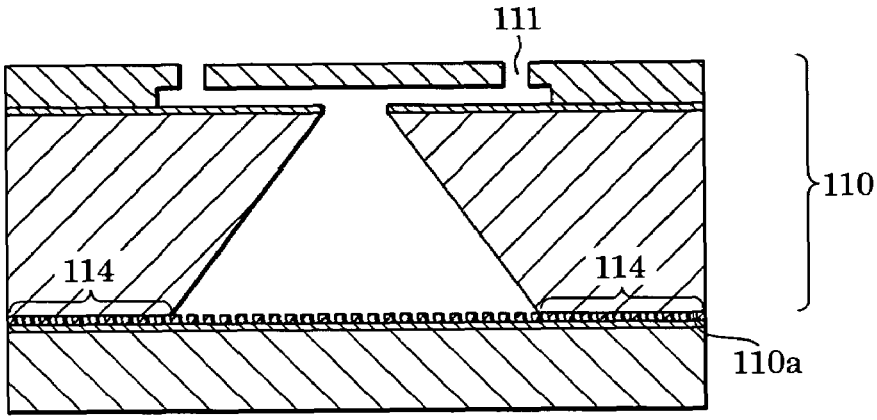

Through holes 103 are formed in the photosensitive resin layer 101 as in the first embodiment (FIG. 5B), and the photosensitive resin layer 101 provided with the through holes 103 is joined to a bonding portion 114 of a bottom surface 110*a* of a head substrate 110 (FIG. 5C).

Figure 5D:
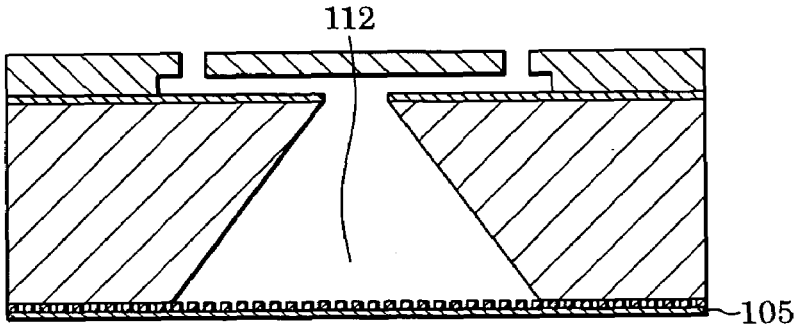

The support component 102 is removed by being dissolved in an organic alkali, tetramethylammonium hydroxide (TMAH), heated to 85° C. In the present embodiment, the support component 102 has a thickness of about 0.2 mm, and is completely removed after about 6 hours. Even if the time exceeds about 6 hours, the etching-protective film made of silicon dioxide serves as an etching-stop layer. Therefore, the etching solution does not enter an ink supply hole 112, and the inside is kept clean (FIG. 5D).

Figure 5E:
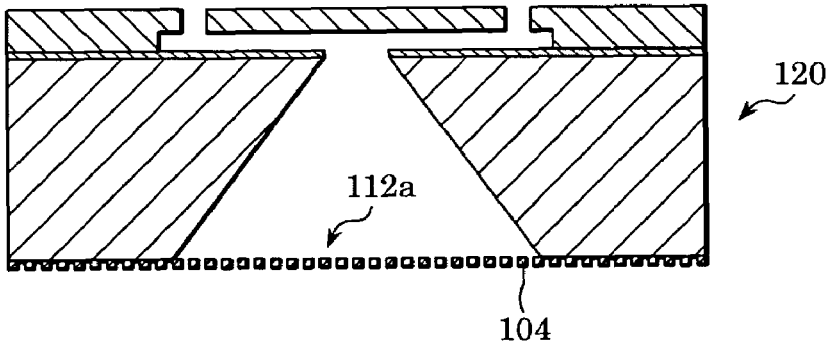

Subsequently, the etching-protective film 105 is removed with ammonium fluoride, and washing with water is performed, so that an ink-jet recording head 120 provided with a filter 104 on an aperture 112*a* of the ink supply hole 112 is formed (FIG. 5E). Thereafter, as in the known manner, the wafer is separated to have a required shape, an external electrode is connected and, for example, a component to connect to an ink tank is attached.

In this manner, the ink-jet recording head according to the present embodiment, provided with the filter 104 is completed, wherein the filter 104 is formed such that the diameter of the through hole 103 is made smaller than or equal to a maximum linear distance between intersection points of a straight line passing through the geometric center of the ejection nozzle 111 and an edge of the ejection nozzle 111.

Third Embodiment

FIGS. 6A to 6E are step diagrams showing a filter formation process in a method for manufacturing an ink-jet recording head according to a third embodiment.

In the present embodiment, joining between a head substrate and a filter is performed by a metallic bond, and other steps are similar to those in the first and second embodiments. Therefore, only the steps different from those in the second embodiment will be described below in detail.

Figure 6A:
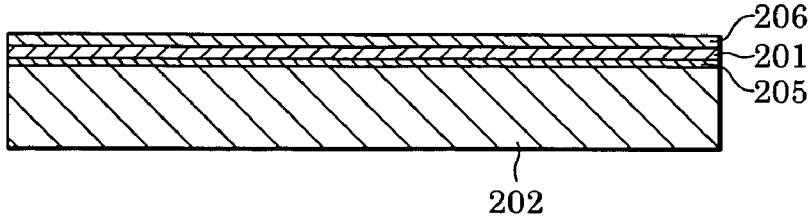
FIGS. 6A to 6E are step diagrams showing a filter formation process in the method for manufacturing an ink-jet recording head according to a third embodiment of the present invention.

About 3,000 angstroms of silicon dioxide ($SiO_2$) serving as an etching-protective film 205 is formed on a support component 202, on the side to be provided with a photosensitive resin layer 201. Subsequently, the photosensitive resin layer 201 is formed on the etching-protective film 205 in a manner similar to that in the first and second embodiments, and a metal layer 206 is further formed (FIG. 6A). In the present embodiment, the metal layer 206 is formed from gold of about 5,000 angstroms in thickness. Examples of methods for forming the metal layer include vacuum evaporation, sputtering, electrolysis, and electroless plating. In the present embodiment, the metal layer 206 is formed by sputtering.

Figure 6B:
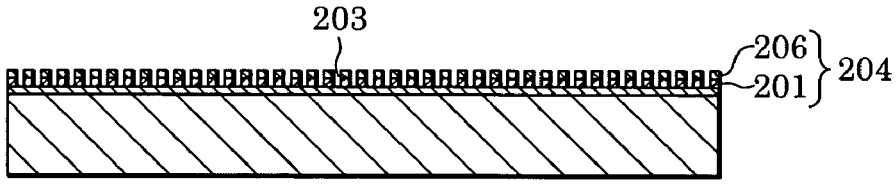

Through holes 203 are formed in the photosensitive resin layer 201 as in the first and second embodiments, so that a filter 204 is formed on a support component 202 (FIG. 6B).

On the other hand, as described in the first embodiment, the head substrate 210 is formed beforehand in the usual procedure, and the procedure is suspended before high-temperature baking to enhance the adhesion of a flow-path-forming component to the substrate 13, while the flow-path-forming component forms a plurality of ejection nozzles 211 and channels serving as a plurality of ink flow paths 6 in accordance with respective ejection nozzles 211. At this time, a substrate-side metal layer 215 is formed on a bottom surface 210*a* in the step of forming an ink supply hole 212 of the head substrate 210, and is left on a bonding portion 214. Preferably, gold, aluminum, copper, or the like is used as the substrate-side metal layer 215, and a method for manufacturing the substrate-side metal layer 215 may be any one of vacuum evaporation, sputtering, electrolysis, electroless plating, and the like.

In this manner, the filter 204 including the metal layer 206 as an uppermost layer and the head substrate 210 including the substrate-side metal layer 215 on the bonding portion 214 of the bottom surface 210*a* are formed.

Figure 6C:
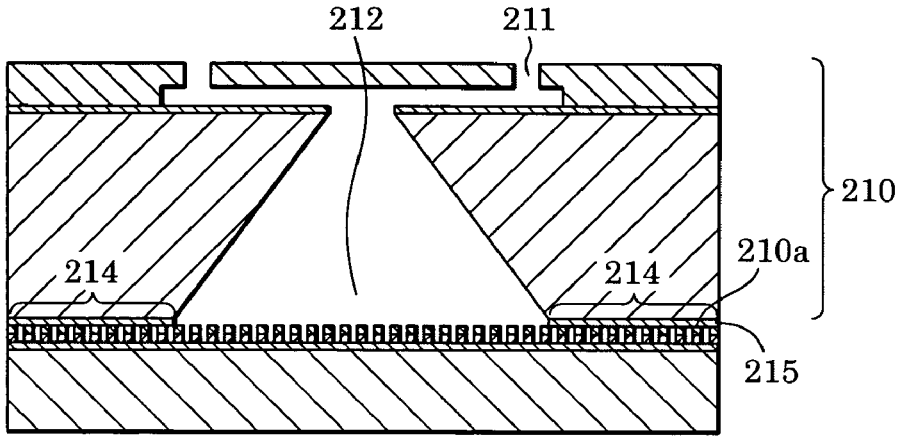
Figure 6D:
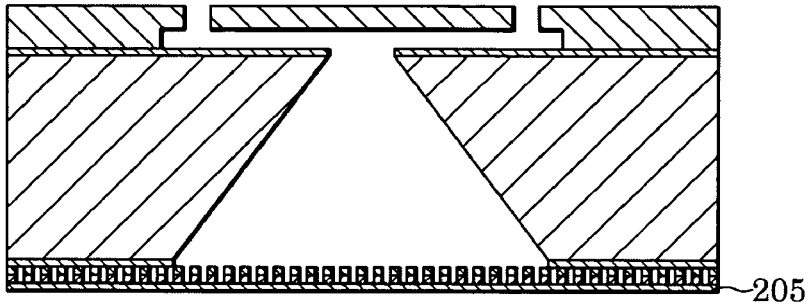

The metal layer 206 of the filter 204 and the substrate-side metal layer 215 of the head substrate 210 are faced to each other, and are put in a vacuum chamber, although not shown in the drawing. Argon is used as a cleaning gas, and the metal surfaces are subjected to reverse sputtering with argon plasma, so that each metal surface is made to be a cleaned surface. The substrates are brought into contact with each other without being further treated, and a force of about 4.9 N is applied, so that the metal layer 206 and the substrate-side metal layer 215 are joined (FIG. 6C). The metal layer 206 and the substrate-side metal layer 215 may be joined at ambient temperature, or be joined by heating. The metal layer 206 and the substrate-side metal layer 215 may be joined by being brought into contact without application of a pressure, and at this time, the joining may be performed at ambient temperature or by heating.

Figure 6E:
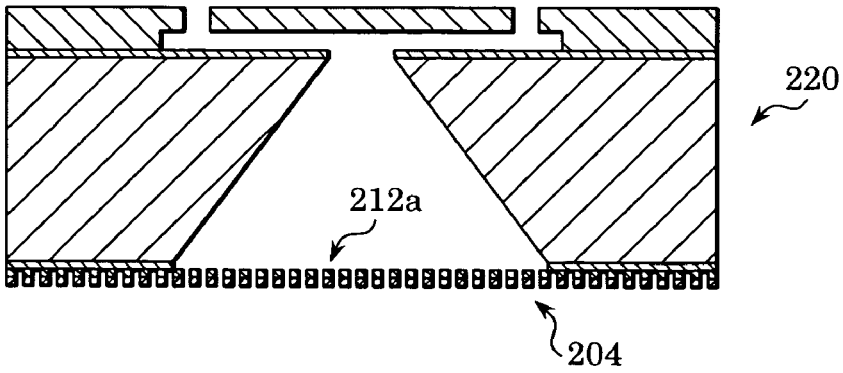

Subsequently, the support component 202 is removed by dissolution as in each of the above-described embodiments (FIG. 6D), the etching-protective film 205 is removed with ammonium fluoride, and washing with water is performed, so that an ink-jet recording head 220 provided with the filter 204 on an aperture 212*a* of the ink supply hole 212 is formed (FIG. 6E). Thereafter, as in the known manner, the wafer is separated to have a required shape, an external electrode is connected and, for example, a component to connect to an ink tank is attached.

In this manner, the ink-jet recording head according to the present embodiment, provided with the filter 204 is completed, wherein the filter 204 is formed in order that the diameter of the through hole 203 is made smaller than or equal to a maximum linear distance between intersection points of a straight line passing through the geometric center of the ejection nozzle 211 and an edge of the ejection nozzle 211.

Supplemental descriptions will be provided on the manufacturing methods in the above-described embodiments, and a modified example applicable to each of the embodiments will be described with reference to FIGS. 7A and 7B and FIGS. 8A and 8B.

In each of the methods for manufacturing an ink-jet recording head of the present invention, the filter disposed on the support component is bonded or joined to the substrate provided with the ink supply hole. In the description of each embodiment, the number of recording head was limited to one in order to simplify the explanation. However, in practice, a plurality of recording heads (chips) are prepared on one wafer through, for example, a process for manufacturing a semiconductor. Thereafter, the wafer is cut, and the resulting recording head is connected to an external electrode and an ink tank.

Figure 7A:
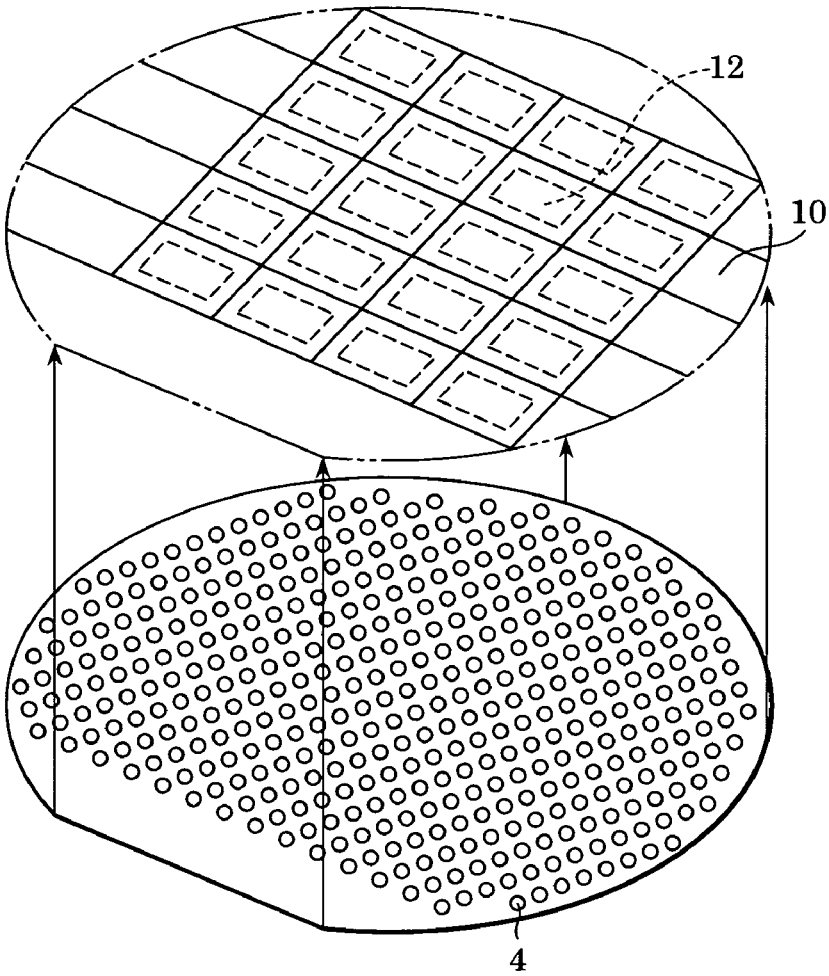
FIGS. 7A and 7B are illustrative diagrams showing the method for manufacturing an ink-jet recording head of the present invention.
Figure 7B:
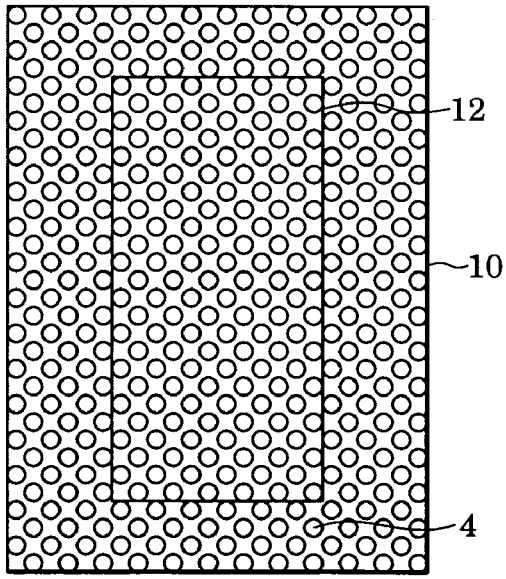

Here, as shown in FIG. 7A, when the filter is attached to the head substrate 10 provided with the flow-path-forming components, wafers are joined to each other in the present invention. At this time, since the above-described filter 4 has been formed all over the support component, it is unnecessary to make sure the filter is in a proper alignment with an ink supply hole 12 of each chip during joining. FIG. 7B is a schematic diagram of the recording head viewed from the back of the substrate, wherein the recording head was cut from the wafer after a plurality of through holes were disposed at a constant spacing. As is clear from this schematic diagram, through holes are disposed at a constant spacing all over the back of the substrate of the head, and a portion, where the ink supply hole 12 is present, practically performs the function as a filter.

Figure 8A:
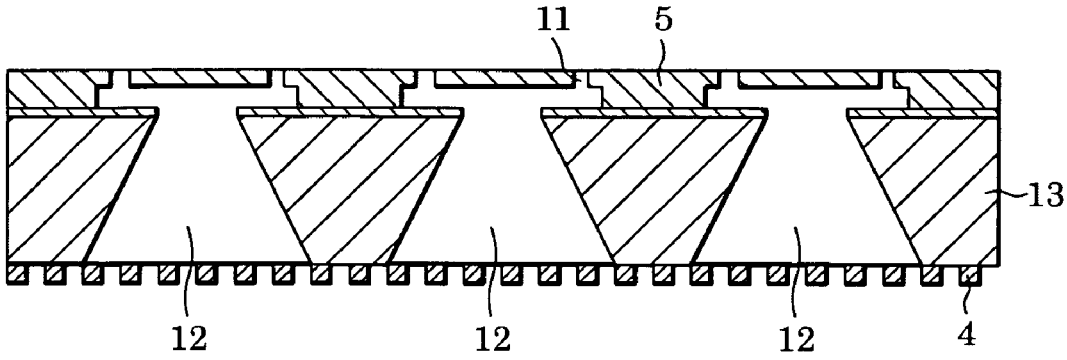
FIGS. 8A and 8B are illustrative diagrams showing a modified example of the ink-jet recording head of the present invention.
Figure 8B:
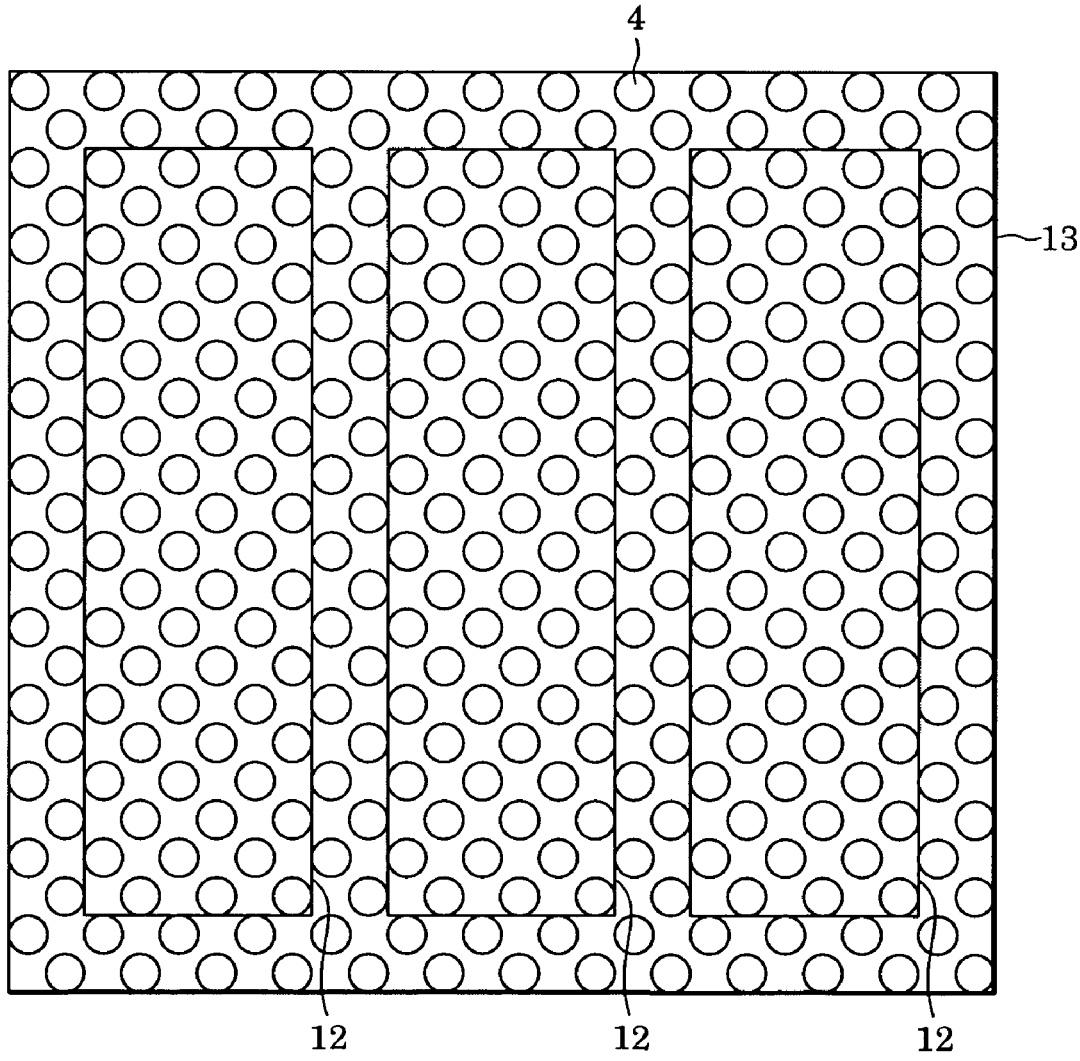

FIGS. 8A and 8B show a modified example applicable to each embodiment of the present invention. In above-described each embodiment, one recording head is provided with one ink supply hole. However, as shown in FIGS. 8A and 8B, the present invention can be applied to a recording head provided with a plurality of ink supply holes 12. The ink supply holes may be supplied with mutually different types of ink, or be supplied with the same ink. With respect to such a recording head as well, by applying the present invention, it is unnecessary to give attention to the alignment when the filter is disposed on each ink supply hole, as shown in FIG. 8B. Consequently, a recording head having a desired performance of removing dust can readily be provided.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application Nos. 2003-434527 and 2004-327664 filed Dec. 26, 2003 and Nov. 11, 2004, respectively, which are hereby incorporated by reference herein.

What is claimed is:

1. A method for manufacturing an ink-jet recording head provided with ejection nozzles, the method comprising the steps of:

providing a support component;

forming a resin layer on the support component;

forming a plurality of through holes in the resin layer such that said each through hole has an aperture diameter smaller than, or equal to, a maximum linear distance between intersection points of a straight line passing through a geometric center of the ejection nozzle and an edge of the ejection nozzle in an ejection nozzle surface;

forming a substrate including a first surface and a second surface opposing the first surface, the ejection nozzles provided about the first surface, thermal energy generating elements disposed about the ejection nozzles at the first surface, and an ink supply hole penetrating through the first surface to the second surface;

joining the resin layer to the second surface of the substrate; and removing the support component from the resin layer.

2. The method for manufacturing an ink-jet recording head according to claim 1, wherein the support component includes at least one of a silicon wafer and a metal capable of being etched.

3. The method for manufacturing an ink-jet recording head according to claim 1, wherein the resin layer includes a photosensitive resin.

4. The method for manufacturing an ink-jet recording head according to claim 1, wherein the joining step includes the steps of:

coating the second surface of the substrate with a polyamide;

joining the resin layer provided with said through holes into intimate contact with the second surface coated with the polyamide; and performing heat bonding.

5. The method for manufacturing an ink-jet recording head according to claim 1, the method further comprising the steps of:

forming a metal layer on the resin layer after the step of forming the resin layer on the support component;

forming the through holes in the metal layer and the resin layer;

forming a head-side metal layer on the second surface of the substrate;

cleaning the metal layer and the head-side metal layer with a cleaning gas in a vacuum atmosphere; and joining the metal layer into intimate contact with the head-side metal layer and then pressurizing the metal layer joined with the head-side metal layer.

6. The method for manufacturing an ink-jet recording head according to claim 5, further comprising a step of heating the metal layer joined with the head-side metal layer after the step of joining the metal layer into intimate contact with the head-side metal layer.

7. The method for manufacturing an ink-jet recording head according to claim 1, wherein the step of forming the through holes includes forming the through holes in an area of the resin layer larger than an aperture area of the ink supply hole.

8. The method for manufacturing an ink-jet recording head according to claim 1, wherein the step of forming the substrate includes the step of forming the ink supply hole such that an aperture area of the ink supply hole at the second surface is larger than an aperture area of the ink supply hole at the first surface.

* * * * *